United States Patent [19]

Chihaya et al.

[11] Patent Number: 4,969,685

[45] Date of Patent: Nov. 13, 1990

[54] POWDERED ROTATING SEAT

[75] Inventors: Masayoshi Chihaya; Masami Yonekura, both of Kanagawa, Japan

[73] Assignee: Ikeda Bussan Co., Ltd., Ayase, Japan

[21] Appl. No.: 356,416

[22] Filed: May 25, 1989

[30] Foreign Application Priority Data

Aug. 24, 1988 [JP] Japan ..... 63-111004[U]

[51] Int. Cl.[5] ..... A47C 3/18

[52] U.S. Cl. ..... 297/349; 74/421 A; 108/20

[58] Field of Search ..... 297/349; 108/20, 22, 108/94, 142; 248/425; 74/421 A, 425; 312/252; 219/10.55 E, 10.55 F

[56] References Cited

U.S. PATENT DOCUMENTS 3,937,096 2/1976 Lundin et al. ..... 74/421 A
4,219,715 8/1980 Mandle et al. ..... 219/10.55 E X
4,555,990 12/1985 Egawa ..... 108/20
4,600,239 7/1986 Gerstein ..... 297/349
4,636,605 1/1987 Berend et al. ..... 219/10.55 E X
4,708,027 11/1987 Stenner ..... 74/421 A
4,808,781 2/1989 Liu ..... 219/10.55 E X

FOREIGN PATENT DOCUMENTS 60-152349 10/1985 Japan .
37550 2/1986 Japan ..... 297/330

*Primary Examiner*—Peter R. Brown
*Attorney, Agent, or Firm*—Foley & Lardner, Schwartz, Jeffery, Schwaab, Mack, Blumenthal & Evans

[57] ABSTRACT

Herein disclosed is a powered rotating seat which comprises a seat proper; a lower base member adapted to be mounted on a floor, the lower base member including a structure by which an annular groove is defined; an upper base member mounting thereon the seat proper, the upper base member having a circular opening defined by an annular flange portion thereof, the upper base member being put on the lower base member having the annular flange portion slidably received in the annular groove; and an electric drive unit for rotating the upper base member relative to the lower base member upon energization thereof, the drive unit being installed in an inner space which is defined by the lower and upper base members.

3 Claims, 6 Drawing Sheets

POWDERED ROTATING SEAT

BACKGROUND OF THE INVENTION

1. Field of the Invention

The present invention relates in general to seats, and more particularly to, seats of a type which is rotated about a vertical axis thereof by an electric drive unit.

2. Description of the Prior Art

One of conventional seats of the above-mentioned powered type is disclosed in Japanese Utility Model First Provisional Publication No. 60-152349. The seat comprises generally a seat proper, a rotating support unit rotatably supporting thereon the seat proper and consisting of a fixed lower base member and a rotatable upper base member, and an electric drive unit arranged beside the support unit to drive the upper base member.

However, in the conventional seat, the arrangement of the drive unit relative to the rotating support unit is given little thought. In fact, the drive unit located beside the support unit causes the entire seat to have a bulky construction.

SUMMARY OF THE INVENTION

It is therefore an essential object of the present invention to provide a powered rotating seat which is compact in size.

According to the present invention, there is provided a powered rotating seat which is simple in construction, economical to manufacture and efficient in operation.

According to the present invention, there is provided a powered rotating seat which comprises a seat proper; a lower base member adapted to be mounted on a floor, the lower base member including a structure by which an annular groove is defined; an upper base member mounting thereon the seat proper, the upper base member having a circular opening defined by an annular flange portion thereof, the upper base member being put on the lower base member having the annular flange portion slidably received in the annular groove; and an electric drive unit for rotating the upper base member relative to the lower base member upon energization thereof, the drive unit being installed in an inner space which is defined by the lower and upper base members.

SUMMARY OF THE DRAWINGS

Other objects and advantages of the present invention will become apparent from the following description when taken in conjunction with the accompanying drawings, in which:

FIGS. 1 to 4 are drawings showing a powered rotating seat of a first embodiment of the present invention, in which, FIG. 1 is a vertically sectional view of an essential of the seat;

FIG. 2 is an exploded but partial view of the essential of the seat;

FIG. 3 is a perspective view of a drive unit which constitutes part of the essential portion; and FIG. 4 is a side view of the powered rotatable seat;

FIGS. 5 to 7 are drawings showing a powered rotatable seat of a second embodiment of the present invention in which, FIG. 5 is a vertically sectional view of an essential portion of the seat;

FIG. 6 is an exploded view of the essential portion of the seat; and

FIG. 7 is a perspective view of a drive unit which constitutes part of the essential portion;

FIGS. 8 and 9 are drawings showing a powered rotatable seat of a third embodiment of the present invention, in which, FIG. 8 is a vertically sectional view of an essential portion of the seat; and FIG. 9 is an exploded view of the essential portion of the seat; and FIGS. 10 and 11 are drawings showing a powered rotatable seat of a fourth embodiment of the present invention, in which, FIG. 10 is a vertically sectional view of an essential portion of the seat; and FIG. 11 is an exploded view of the essential portion.

DETAILED DESCRIPTION OF THE INVENTION

Referring to FIGS. 1 to 4, there is shown a powered rotating seat 10 which is a first embodiment of the present invention.

Figure 4:
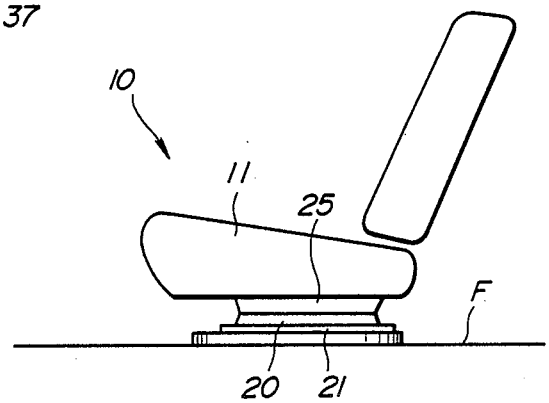

As is seen from FIG. 4, the powered rotating seat 10 comprises generally a seat proper 11, a rotating support unit 20 supported on a floor F and supporting thereon the seat proper 1, and a drive unit 30 (see FIG. 1) installed within the support unit 20 to actuate the same. The seat proper 11 illustrated comprises a seat cushion part and a seatback part.

Figure 1:
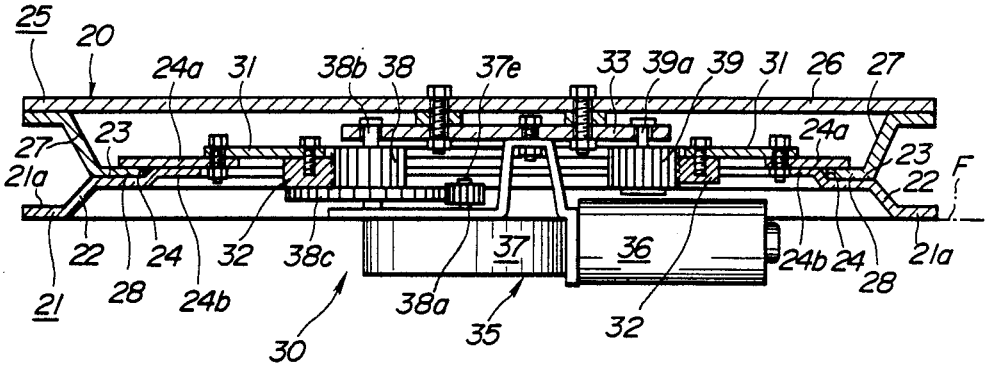

As is seen from FIG. 1, the rotating support unit 20 comprises a lower base member 21 which is secured to the floor F and a rotatable upper base member 25 which is rotatable relative to the fixed lower base member 21.

The lower base member 21 is shaped rectangular and comprises a lower flange portion **21*a* secured to the floor F and a rectangular raised portion 22. The rectangular raised portion 22 has at its center part a raised circular platform which is formed with a circular aperture. Thus, as will be understood as the description proceeds, the raised portion 22 constitutes about the raised circular platform a so-called bearing surface 23. An annular ring 24*a* having a diameter larger than that of the circular platform is coaxially connected, by bolts, to the circular platform. With this, an annular groove 24 is defined around the circular platform between the bearing surface 23 and an outer peripheral portion of the annular ring 24*a***.

The upper base member 25 comprises a rectangular base plate 26 on which the seat cushion part of the seat proper 11 is securely mounted, and a rectangular downwardly protruded portion 27. The protruded portion 27 is formed with a circular aperture defining an annular flange portion 28 of the portion 27.

The upper base member 25 is put on the lower base member 21 having the annular flange portion 28 slidably received in the annular groove 24. With this, the upper base member 25 is rotatable about a vertical axis relative to the lower base member 21. In order to smooth the rotation of the upper base member 25, grease is applied to the bearing surface 23.

Figure 2:
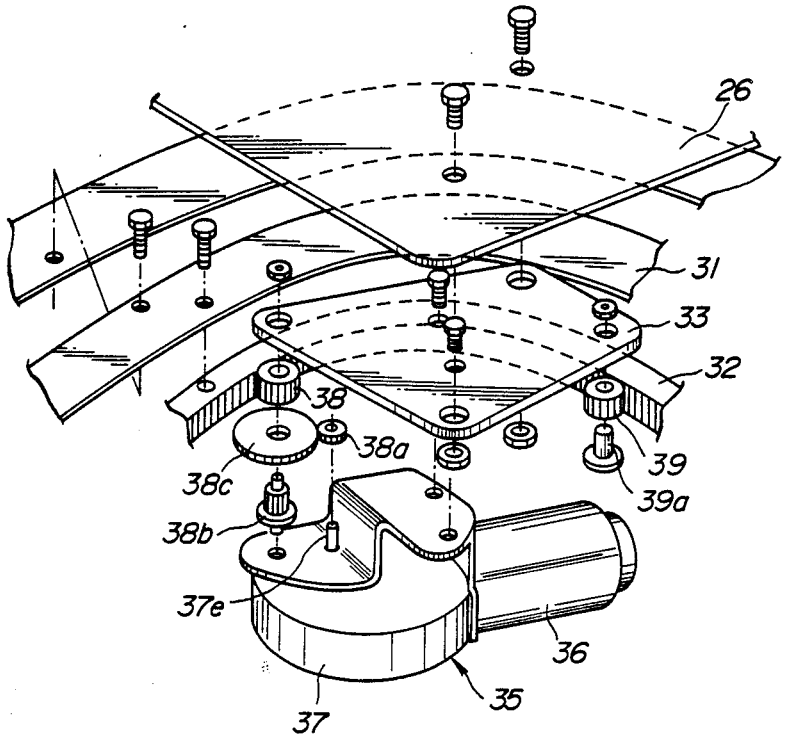

As is seen from FIGS. 1 and 2, the drive unit 30 is installed between the lower base member 21 and the upper base member 25.

The drive unit 30 comprises a fixed ring gear 32 which is coaxially arranged in the circular aperture of the lower base member 21 and secured to the annular ring **24*a* through an annular supporter ring 31**. The ring gear is formed with a plurality of teeth on an inner cylindrical surface thereof, as is understood from FIG. 2.

The rectangular base plate 26 has at its lower surface an electric motor assembly 35 secured thereto through a mounting plate 33 and exposed to the circular aperture of the lower base member 21. A plurality of bolts and nuts are used for connecting the electric motor assembly 35 to the rectangular base plate 26, as is seen from FIG. 2. The electric motor assembly 35 comprises an electric motor 36 and a speed reduction gear 37.

Figure 3:
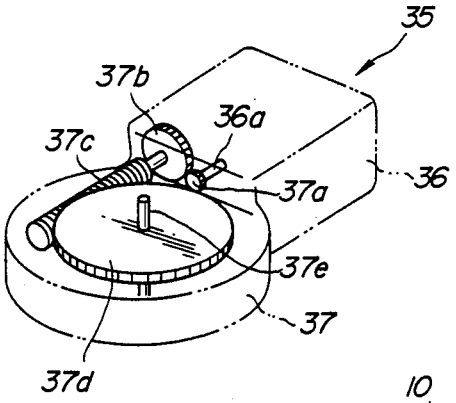

As is seen from FIG. 3, the speed reduction gear 37 of the motor assembly 35 comprises a smaller gear **37*a* secured to a power shaft 36*a* of the motor 36, a larger gear 37*b* meshed with the smaller gear 37*a*, a worm 37*c* coaxially connected to the larger gear 37*b*, a worm wheel 37*d* meshed with the worm 37*c* and an output shaft 37*e* secured to the worm wheel 37*d***.

As is seen from FIG. 2, the output shaft **37*e* of the speed reduction gear 37 is projected upward and has a smaller gear 38*a* secured thereto. Meshed with the smaller gear 38*a* is a larger gear 38*c* which is splined to a pivot shaft 38*b*. The pivot shaft 38*b* extends in parallel with the output shaft 37*e* between the housing of the reduction gear 37 and the mounting plate 33. An output gear 38 is also splined to the pivot shaft 38*b* to rotate therewith and meshed with the teeth of the ring gear 32**.

At a position remote from the output gear 38, there is arranged a follower gear 39, which is rotatably connected through a pivot shaft **39*a* to the mounting plate 33. The follower gear 39 is meshed with the teeth of the ring gear 32. Preferably, the follower gear 39 is positioned at a diametrically opposed portion of the output gear 38 with respect to the ring gear 32**.

In the following, operation will be described.

For ease of understanding, the description of operation will be commenced with respect to a rest condition of the drive unit 30.

Under this rest condition, the upper base member 25 on which the seat proper 11 is mounted is kept stationary even when an external force is applied to the seat proper. This is because of a large resistance which is produced by the speed reduction gear 37 under such condition. Furthermore, because of the output gear 38 and the follower gear 39 which are arranged at diametrically opposed portions of the gear ring 32, undesirable play of the upper base member 25 relative to the lower base member 21 is suppressed or at least minimized.

When the electric motor 36 is energized, the power of the motor 36 is transmitted to the output gear 38 through the speed reduction gear 37 and another speed reduction mechanism which consists of the smaller gear **38*a* and the larger gear 38*c*. Thus, the output gear 38 runs on and along the teeth of the fixed ring gear 32 turning the upper base member 25 about an axis of the ring gear 32 relative to the fixed lower base member 21. Thus, the seat proper 11 turns relative to floor F. During this turning, the annular flange portion 28 of the upper base member 25 slidably runs in and along the annular groove 24 of the lower base member 21 thereby suppressing or at least minimizing undesirable pitching or rolling action of the seat proper 11**.

When the seat proper 11 is turned to a desired position, energization of the electric motor 36 is ceased. With this, the seat proper 11 is kept at the desired position.

Figure 5:
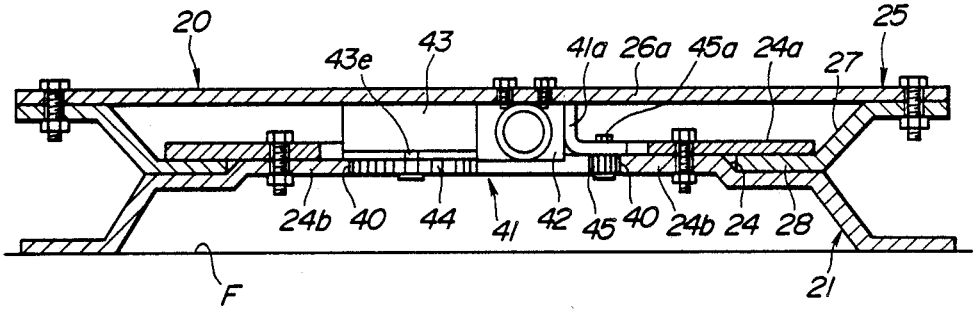
Figure 6:
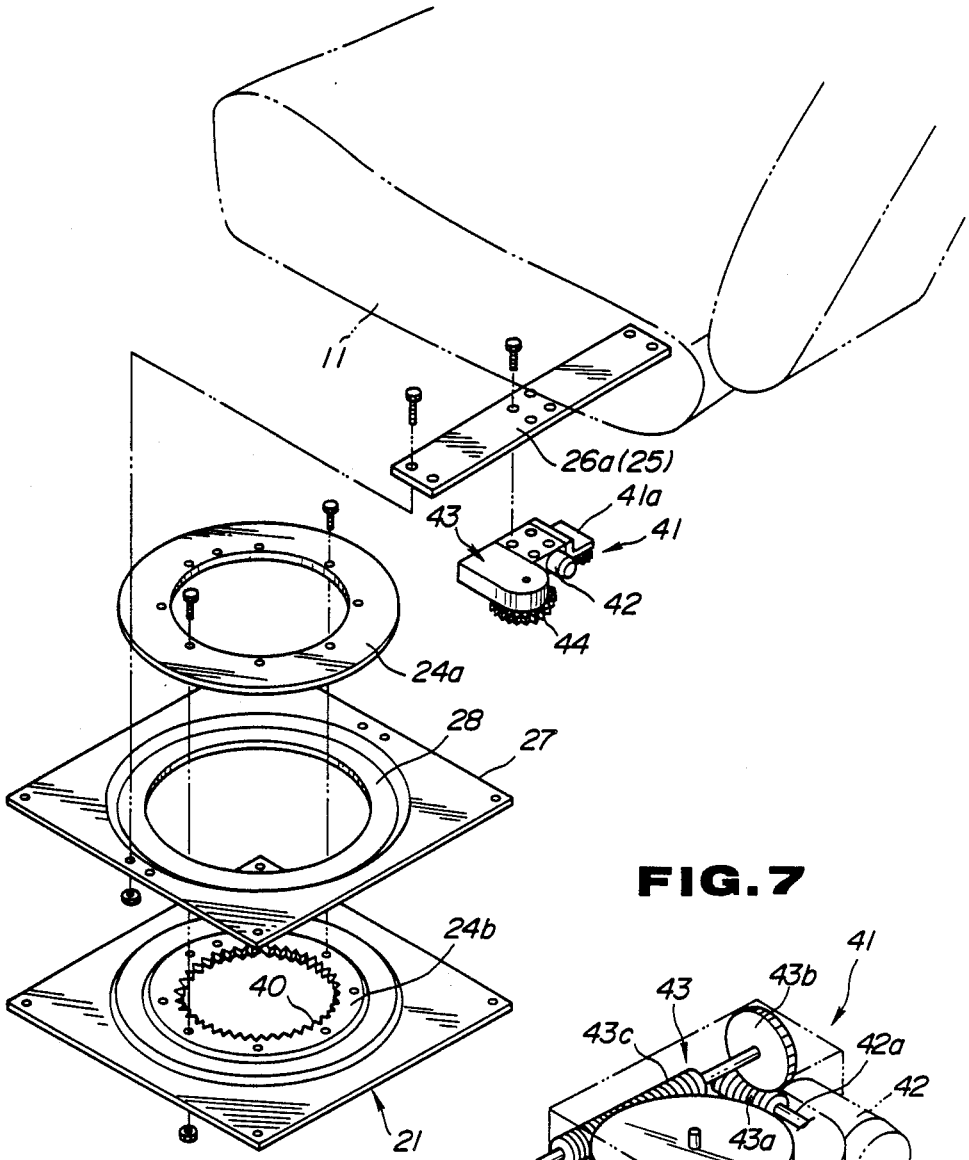
Figure 7:
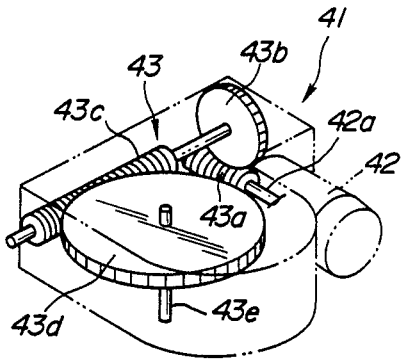

Referring to FIGS. 5 to 7, there is shown a second embodiment of the present invention. Parts and structures substantially the same as those of the first embodiment are denoted by the same numerals and detailed explanation of them will be omitted from the following description.

As is seen from FIGS. 5 and 6, a powered rotating seat of the second embodiment comprises generally a seat proper 11, a rotating support unit 20 and a drive unit.

The rotating support unit 20 comprises a fixed lower base member 21 and a rotatable upper base member 25 which are assembled in a manner similar to the afore-mentioned first embodiment, as will be seen from FIG. 5.

However, in this second embodiment, means which corresponds to the gear ring 32 of the first embodiment is a plurality of teeth 40 which are formed on an inner surface of a raised circular platform **24*b* of the lower base member 21** by which the circular aperture is defined.

The drive unit comprises the teeth 40 and an electric motor assembly 41. The motor assembly 41 is secured to a lower surface of a rectangular base plate **26*a* of the upper base member 25 and comprises generally an electric motor 42 and a speed reduction gear 43**.

As is seen from FIG. 7, the speed reduction gear 43 comprises a first worm **43*a* secured to a power shaft 42*a* of the motor 42, a first worm wheel 43*b* meshed with the first worm 43*a*, a second worm 43*c* coaxially connected to the first worm wheel 43*b*, a second worm wheel 43*d* meshed with the second worm 43*c* and an output shaft 43*e* secured to the second worm wheel 43*d***.

As is seen from FIG. 5, the output shaft **43*e* of the speed reduction gear 43 is projected downward and has an output gear 44 secured thereto. The output gear 44 is meshed with the teeth 40 of the raised circular platform 24*b* of the lower base member 21. Similar to the case of the first embodiment, a follower gear 45 is rotatably connected through a pivot shaft 45*a* to a bracket 41*a* which is secured to the electric motor assembly 41**.

Since operation of the second embodiment is substantially the same as that of the afore-mentioned first embodiment, description of it will be omitted.

Figure 8:
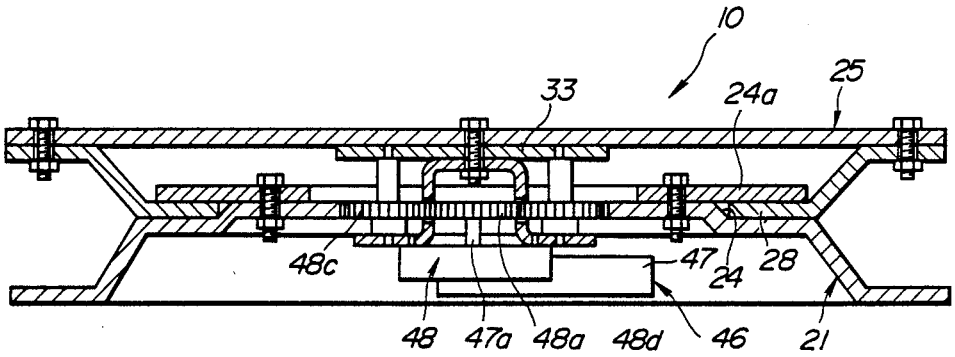
Figure 9:
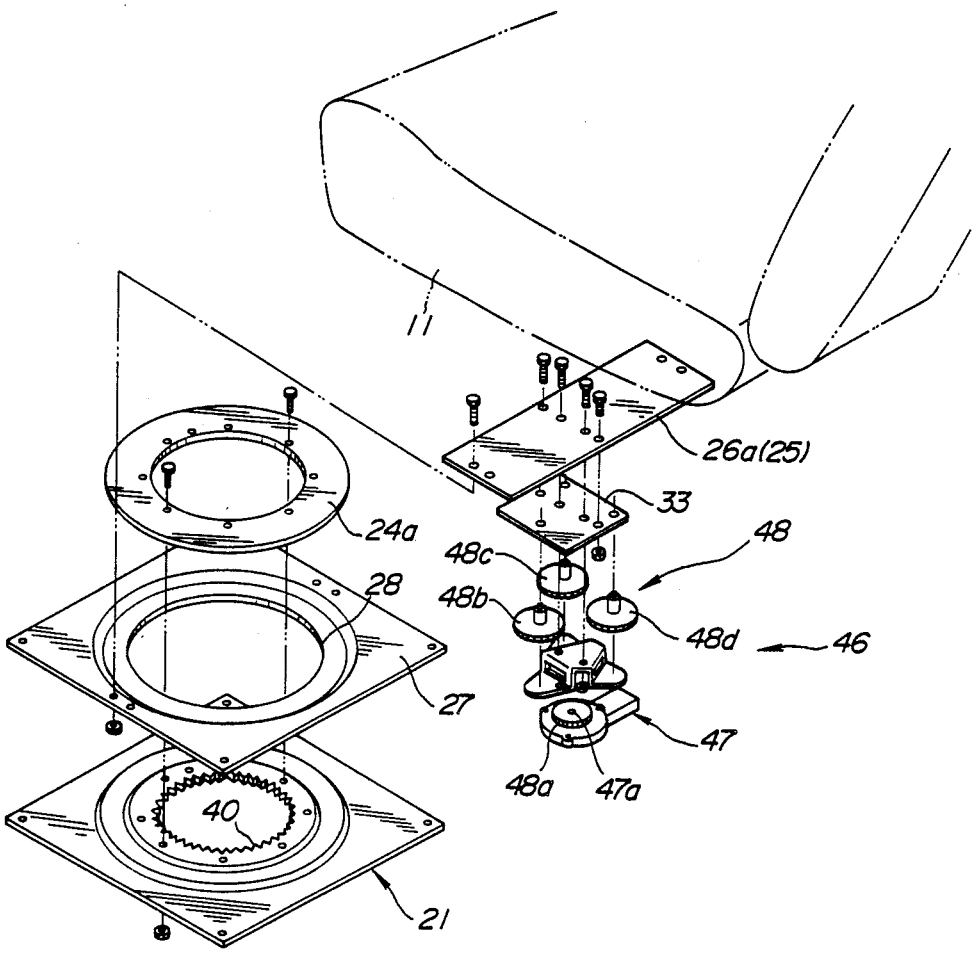

Referring to FIGS. 8 and 9, there is shown a third embodiment of the present invention. The powered rotating seat of this third embodiment is substantially the same as the afore-mentioned second embodiment except the drive unit. Thus, only the drive unit will be described in the following.

As is seen from FIG. 9, the drive unit comprises teeth 40 of the lower base member 21 and an electric motor assembly 46. The motor assembly 46 is secured to a lower surface of a rectangular base plate **26*a* of the upper base member 25 and comprises generaly an electric motor 47 and a speed reduction gear 48**.

The speed reduction gear 48 comprises a sun gear **48*a* which is secured to a power shaft 47*a* of the motor 47, and three planetary gears 48*b*, 48*c* and 48*d* which are meshed with the sun gear 48*a* and rotatably connected through respective pivot shafts to the base plate 26*a*. Designated by numeral 33 is a mounting plate disposed between the planetary gears and the base plate 26*a*. The planetary gears 48*b*, 48*c* and 48*d* are meshed with the teeth 40 of the lower base member 21. If desired, a speed reduction unit consisting of a worm and a worm wheel may be arranged between the motor 47 and the sun gear 48*a***.

Upon energization of the motor 47, the sun gear **48*a* rotates turning the planetary gears 48*b*, 48*c* and 48*d* about their respective shafts. Thus, the planetary gears run on and along the teeth 40 turning the upper base member 25 relative to the fixed lower base member 21, which means that the seat proper 11 mounted on the upper base member 25** rotates relative to the floor F.

Figure 10:
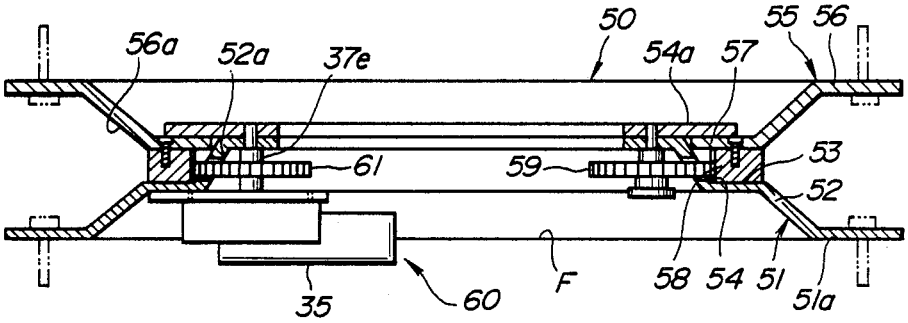
Figure 11:
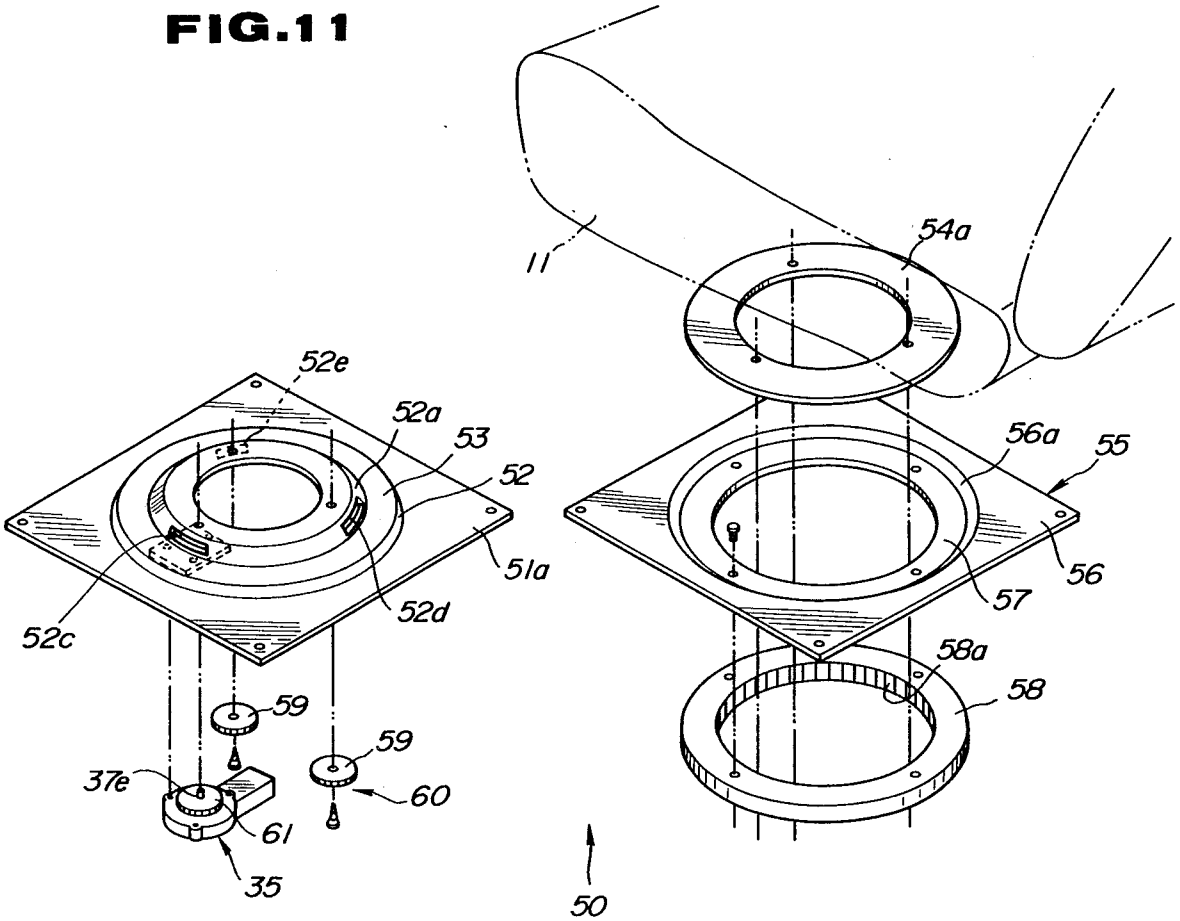

Referring to FIGS. 10 and 11, there is shown a fourth embodiment of the present invention.

The powered rotating seat of this fourth embodiment comprises generally a seat proper 11, a rotating support unit 50 and a drive unit 60. Like the above-mentioned first, second and third embodiments, the drive unit 60 is installed within the rotating support unit 50 in a manner as will be described hereinafter.

The rotating support unit 50 comprises a fixed lower base member 51 and a rotatable upper base member 55.

The lower base member 51 is shaped rectangular and comprises a lower flange portion 51*a* secured to the floor F and a circular raised portion 52. The circular raised portion 52 has at its center part a raised circular platform 52*a* which is formed with a circular aperture. The raised portion 52 constitutes about the raised circular platform a so-called bearing surface 53. For the purpose which will become apparent as the description proceeds, the raised circular platform 52*a* has at its conical portion three apertures 52*c*, 52*d* and 52*e* formed therethrough. An annular ring 54*a* having a diameter larger than that of the circular platform 52*a* is coaxially connected, by bolts, to the circular platform. With this, an annular groove 54 is defined around the circular platform 52*a* between the bearing surface 53 and an outer peripheral portion of the annular ring 54*a*.

The upper base member 55 comprises a rectangular base plate 56 on which the seat proper 11 is securely mounted, and a circular downwardly protruded portion 56*a*. The protruded portion 56*a* has a circular aperture defined by an annular flange portion 57 thereof. The annular flange portion 57 has a ring gear 58 coaxially secured, by bolts, to a lower surface thereof thereby to form a combined annular structure. The ring gear has a plurality of teeth 58 formed on an inner edge thereof.

The upper base member 55 is put on the lower base member 51 having the combined annular structure slidably received in the annular groove 54 of the lower base member 51. With this, the upper base member 55 is rotatable about the axis of the combined annular structure relative to the lower base member 51. Grease is then applied to the bearing surface 53.

The drive unit 60 comprises the ring gear 58 and an electric motor assembly 35 which is secured, by bolts, to a lower surface of the circular platform 52*a* of the lower base member 51. The assembly 35 includes an electric motor and a speed reduction gear, like in the case of the first embodiment.

The electric motor assembly 35 has an output gear 61 secured to an output shaft 37*e* thereof. The output gear 61 is meshed with the teeth 58*a* of the ring gear 58 through the aperture 52*c*. Two follower gears 59 and 59 are rotatably connected through headed pivot pins (no numerals) to the circular platform 52*a*, which are meshed with the teeth 58*a* of the ring gear 58 through the apertures 52*d* and 52*e*.

Upon energization of the motor of the motor assembly 35, the output gear 37*e* drives the ring gear 58 and thus rotates the upper base member 55. This means that the seat proper 11 turns about a vertical axis relative to the floor F. When the seat proper 11 is turned to a desired position, the energization of the motor is ceased.

What is claimed is:

1. A powered rotating occupant supporting seat comprising:

a seat proper;

a lower base member adapted to be mounted on a floor, said lower base member including a structure by which an annular groove is defined;

an upper base member mounting thereon said seat proper, said upper base member having a circular opening defined by an annular flange portion thereof, said upper base member being put on said lower base member having said annular flange portion slidably received in said annular groove;

an internally threaded ring gear secured to said lower base member in a manner to be coaxial with said annular groove;

an output gear meshed with said ring gear;

an electric motor assembly secured to said upper base member;

a speed reduction gear operatively connected to said electric motor to be driven by the same, said speed reduction gear having an output shaft secured to said output gear; and at least one follower gear rotatably connected to said upper base member and meshed with said ring gear, said follower gear being located at a remote position from said output gear.

2. A powered rotating seat as claimed in claim 1, further comprising a speed reduction unit operatively interposed between said output gear and said output shaft of said speed reduction gear.

3. A powered rotating seat as claimed in claim 2, in which said speed reduction unit comprises:

a smaller gear secured to said output shaft to rotate therewith; and a larger gear coaxially connected to said output gear to rotate therewith.

* * * * *